US011636960B2

(12) United States Patent
Kruska et al.

(10) Patent No.: US 11,636,960 B2
(45) Date of Patent: Apr. 25, 2023

(54) SURGE ARRESTER AND PRODUCTION METHOD FOR A SURGE ARRESTER

(71) Applicant: SIEMENS ENERGY GLOBAL GMBH & CO. KG, Munich (DE)

(72) Inventors: Bernd Kruska, Berlin (DE); Henrik Roggow, Berlin (DE)

(73) Assignee: Siemens Energy Global GmbH & Co. KG, Munich (DE)

( * ) Notice: Subject to any disclaimer, the term of this patent is extended or adjusted under 35 U.S.C. 154(b) by 121 days.

(21) Appl. No.: 17/272,410

(22) PCT Filed: Aug. 8, 2019

(86) PCT No.: PCT/EP2019/071288
§ 371 (c)(1),
(2) Date: Mar. 1, 2021

(87) PCT Pub. No.: WO2020/043452
PCT Pub. Date: Mar. 5, 2020

(65) Prior Publication Data

US 2021/0335523 A1 Oct. 28, 2021

(30) Foreign Application Priority Data

Aug. 30, 2018 (DE) ..... 10 2018 214 767.1

(51) Int. Cl.
*H01C 7/12* (2006.01)
*H01C 17/00* (2006.01)

(52) U.S. Cl.
CPC ..... *H01C 7/12* (2013.01); *H01C 17/00* (2013.01)

(58) Field of Classification Search
CPC ..... H01C 7/12; H01C 17/00
See application file for complete search history.

(56) References Cited

U.S. PATENT DOCUMENTS 4,596,310 A 6/1986 Hatakeyama et al.
4,864,456 A * 9/1989 Thuillier ..... H01C 7/12 338/21
6,008,975 A * 12/1999 Kester ..... H01C 7/102 361/111
6,185,813 B1 * 2/2001 Donnola ..... H01C 7/12 29/613

(Continued)

FOREIGN PATENT DOCUMENTS

CN 101093741 A 12/2007
CN 101123132 A 2/2008

(Continued)

OTHER PUBLICATIONS

CN106098264, Lu et al., machine translation. (Year: 2016).*

(Continued)

*Primary Examiner* — Kyung S Lee
(74) *Attorney, Agent, or Firm* — Laurence A. Greenberg; Werner H. Stemer; Ralph E. Locher

(57) ABSTRACT

An item of electrical equipment includes a core clad with a glass fiber material. The glass fiber material is preimpregnated with a resin. A layer of a substance is applied to the glass fiber material. The substance is formed at least partly of high-temperature vulcanizing silicone rubber. A corresponding production method is also provided.

14 Claims, 2 Drawing Sheets

(56) References Cited

U.S. PATENT DOCUMENTS

| | | | | |
|---|---|---|---|---|
| 7,015,786 | B2 * | 3/2006 | Ramarge | H01C 7/102<br>338/21 |
| 2008/0136578 | A1 * | 6/2008 | Kruska | H01C 1/034<br>361/126 |
| 2019/0057797 | A1 * | 2/2019 | Roggow | H01C 7/126 |

FOREIGN PATENT DOCUMENTS

| | | | |
|---|---|---|---|
| CN | 104952562 | A | 9/2015 |
| CN | 106098264 | A | 11/2016 |
| CN | 106158181 | A | 11/2016 |
| DE | 19927940 | A1 | 12/2000 |
| DE | 102014222451 | A1 | 3/2016 |
| EP | 1067565 | A2 | 1/2001 |
| EP | 1091365 | A1 | 4/2001 |
| EP | 1436819 | B1 | 4/2012 |
| EP | 2444982 | A1 | 4/2012 |
| JP | 2003092205 | A | 3/2003 |

OTHER PUBLICATIONS

DE000019927940, Bohrisch et al., machine translation. (Year: 2000).*
EP1091365. Pimper et al., machine translation. (Year: 2001).*

* cited by examiner

SURGE ARRESTER AND PRODUCTION METHOD FOR A SURGE ARRESTER

BACKGROUND OF THE INVENTION

Field of the Invention

The invention relates to an item of electrical equipment having a core which is clad with a glass fiber material, the glass fiber material being preimpregnated with a resin. The invention also relates to a production method for an item of electrical equipment which includes stabilizing a core by cladding with a glass fiber material, the glass fiber material being preimpregnated with a resin.

Surge arresters are used in the medium-voltage and high-voltage sectors in order to divert so-called overvoltages, i.e. voltages far above the rated voltages intended during operation, safely to ground. This avoids damage to items of electrical equipment, for example transformers. For example, a surge arrester for high voltage may be arranged on an overhead line and divert unacceptably large currents to ground in the event of a lightning strike or short circuit. Surge arresters substantially comprise a housing and metal oxide resistors, so-called varistors. Varistors are electrical resistors whose resistance is very high up to a design-related threshold voltage and is greatly reduced above the threshold voltage, so that the surge arrester becomes a good electrical conductor. For example, metal oxide resistors in the form of disks are arranged above one another in a housing and are connected at the respective ends of the housing to the high-voltage potential and the ground potential. The housing is used to protect the resistors against external influences and mechanical stresses. The surge arrester in this case scarcely conducts during regular operation, so that only a small leakage current flows to ground. In the event of a fault, however, a large dissipation current flows.

Document EP 1 436 819 B1 discloses a surge arrester. The surge arrester is provided for the medium-voltage level and comprises a plurality of varistor blocks, which are stacked above one another to form an arrester column. The arrester column is mechanically stabilized by wrapping a preimpregnated (with a resin) fiber material around it (wrap design). The fiber material is configured as a fabric, i.e. individual fibers of the material cross over alternately. When the preimpregnated fiber material is cured, a conventional housing consisting of silicone having shields to lengthen a creepage path is applied, for example by an injection molding method. An RTC silicone is applied by injection molding for the housing with shields. According to the required crosslinking temperature, distinction is made between cold- (RTC) and hot- (HTC) crosslinking silicone rubbers (RTC=room-temperature crosslinking, HTC=high-temperature crosslinking).

RTC silicones are cured, for example, in a temperature range between a room temperature of 20° C. to about 150° C. At a temperature of 20° C., several hours are typically needed for the curing, while 30 minutes may already be enough at 150° C. In general, an elevated filling pressure is not provided when filling a mold, for example for a housing.

HTC silicones are cured at temperatures of between 155° C. and 170° C. Curing at 165° C. with a duration of 10 minutes and a filling pressure of about 800 bar is typical.

Furthermore known are LSR silicones, which cure between about 105° C. and 150° C., 120° C. for a duration of about 20 minutes at a filling pressure of about 40 bar typically being used.

Silicone is permeable to water vapor. The effect of this during operation is that water vapor can constantly diffuse into the housing and out from the housing. Arresters in wrapped design comprise cavities in the wrapped fiber material as well as in the interface between the wrapped fiber material and the varistor blocks. These cavities cause partial discharges and may become filled with water. Water which has built up may lead to partial discharges and/or to an increase of the power loss in the device. Both mechanisms shorten the lifetime of the device and lead to premature failure. It is particularly critical to prevent the ingress of moisture in the case of devices whose mechanical reinforcement is produced by resin-impregnated glass fiber tapes or mats. In this case, the wrapped active part is cured for a defined time and at a defined temperature (according to manufacturer specifications). The required strength is thereby achieved. Silicone is finally cast around the cured active part. By ingress of moisture, the lifetime of the arrester is significantly reduced. To date, in the prior art, manufacture of arresters in wrapped design has therefore been carried out in a vacuum, which is expensive in terms of time, energy and cost. In this way, cavities are avoided.

SUMMARY OF THE INVENTION

On the basis of the known item of electrical equipment, the object of the invention is to provide an item of electrical equipment which in comparison is particularly weather-resistant, durable and economically producible.

The invention achieves this object by an item of electrical equipment having a core which is clad with a glass fiber material, the glass fiber material being preimpregnated with a resin, and a layer of a substance which is formed at least partially of high-temperature vulcanizing silicone rubber applied onto the glass fiber material.

Surprisingly, it has been shown in tests that with the application of high-temperature vulcanizing (HTV) silicone rubber at a very high pressure of several hundred bars, by the high processing pressure itself very small cavities in the wrapping and in the intermediate layers of the glass fiber material can be filled with silicone. Such pressures are, for example, achieved with the injection molding method.

This has the advantage that it is not necessary to take particular precautions for the application of the glass fiber material, for instance processing in a vacuum, in order to reduce the number and size of cavities or air inclusions, or entirely avoid these cavities. This allows particularly economical production methods, for example for wrapping the core with a glass fiber tape. For example, prefabricated, preimpregnated glass fiber tapes may be used. Single-filament wrapping is not necessary.

Although document EP 1 091 365 B1 discloses a method for producing a hollow composite insulator, in which a plastic tube is internally supported when high-temperature vulcanizing (HTV) silicone rubber is externally applied by the injection molding method in order to apply cladding having creepage path-lengthening shields, the surprising effect, namely that when using HTV on a glass fiber tape it is possible to seal cavities therein, is not however known in the prior art.

By the invention, because of the omission of additional processing steps for the glass fiber tapes, more rapid and more economical manufacture can be achieved. This is advantageous in particular for medium-voltage arresters because there are many manufacturers competing with similar products in this market, which leads to a large pricing pressure. A further advantage is that HTC silicone cures more rapidly than RTC silicone.

In one preferred embodiment of the item of electrical equipment according to the invention, the layer is applied in such a way that cavities between the core and the glass fiber material are substantially filled with the substance. This may, for example, be achieved by high pressures, for example with an injection molding method during manufacture. In general, processing pressures of several hundred bars are needed in order to press the HTC silicone through the glass fiber material and seal very small cavities at the surface of the core. This is an advantage because partial discharges are reduced since no moisture can penetrate into the cavities.

In one preferred embodiment of the item of electrical equipment according to the invention, the layer is applied in such a way that cavities in the glass fiber material are substantially filled with the substance. This may, for example, be achieved by high pressures, for example with an injection molding method during manufacture. In general, processing pressures of several hundred bars are needed in order to press the HTC silicone into the glass fiber material and seal very small cavities between the glass fibers. This is an advantage because partial discharges are reduced since no moisture can penetrate into the cavities.

In one preferred embodiment of the item of electrical equipment according to the invention, the glass fiber material is applied by wrapping around the core. This is an advantage because commercially available glass fiber materials can be purchased economically as rolls. After single- or multilayer wrapping of the core, the material may be cured by the action of heat since it is preimpregnated with a resin. For example, a glass fiber material in tape form according to the Chinese standard "Machinery Industry Standard of the People's Republic of China, JB/T 6236-2015, resin impregnated glass banding tape for electrical insulation" may be used, for example a glass fiber material of the type "2845-W". This is a tape in which the glass fibers run unidirectionally in the longitudinal direction.

In one preferred embodiment of the item of electrical equipment according to the invention, the glass fiber material is applied as a tape which has a width less than the length of the core. This is an advantage because such tapes are commercially available and may therefore be used economically. The tape may, for example, be wrapped obliquely with a partial overlap in order to enclose the entire core. In the case of multilayer wrapping, for example, it is possible to wrap alternately in one direction and then in the other direction.

In one preferred embodiment of the item of electrical equipment according to the invention, the tape is wrapped around the core several times. This is an advantage because particularly good mechanical stabilization is achieved (for example against flexural loads on the item of equipment).

In one preferred embodiment of the item of electrical equipment according to the invention, a housing having creepage path-lengthening shields is provided on the layer, the housing consisting of a material which at least partially comprises a high-temperature vulcanizing silicone rubber. This is an advantage because the HTC silicone can be cured at high temperatures, and this takes place particularly rapidly. This saves time during manufacture and reduces the production costs.

In one refinement of the aforementioned embodiment, the layer and the housing are applied in one piece onto the glass fiber material. The same substance, which respectively contains HTC silicone, is consequently used. This is a particular advantage because the layer and the housing with shields can be applied in only a single step during production. This may, for example, be done with a corresponding mold in an injection molding method. The manufacture therefore becomes even simpler and is accelerated even further. Costs are saved.

In one preferred embodiment of the item of electrical equipment according to the invention, the item of electrical equipment comprises a surge arrester, the core of which comprises an arrester column having a plurality of varistor disks. This is an advantage because the arrester column already has sufficient mechanical stability to withstand the high pressures during the application of the layer and the housing.

In one preferred embodiment of the item of electrical equipment according to the invention, the surge arrester is configured for medium-voltage applications. This is an advantage because, particularly in the case of medium-voltage arresters, strong price competition leads to cost-saving designs being required.

On the basis of known production methods for items of electrical equipment, the object of the invention is to provide a production method with which items of electrical equipment, which in comparison are particularly weather-resistant and durable, can be produced economically.

The invention achieves this object by a production method for an item of electrical equipment which includes stabilizing a core by cladding with a glass fiber material, the glass fiber material being preimpregnated with a resin, and applying a layer of a substance onto the glass fiber material, in which a high-temperature vulcanizing silicone rubber is at least partially used for the substance. Preferred embodiments may be found in the dependent claims. For the production method according to the invention and its embodiments, the same advantages are correspondingly obtained as explained in the introduction for the item of equipment according to the invention.

DETAILED DESCRIPTION OF THE INVENTION

Figure 1:
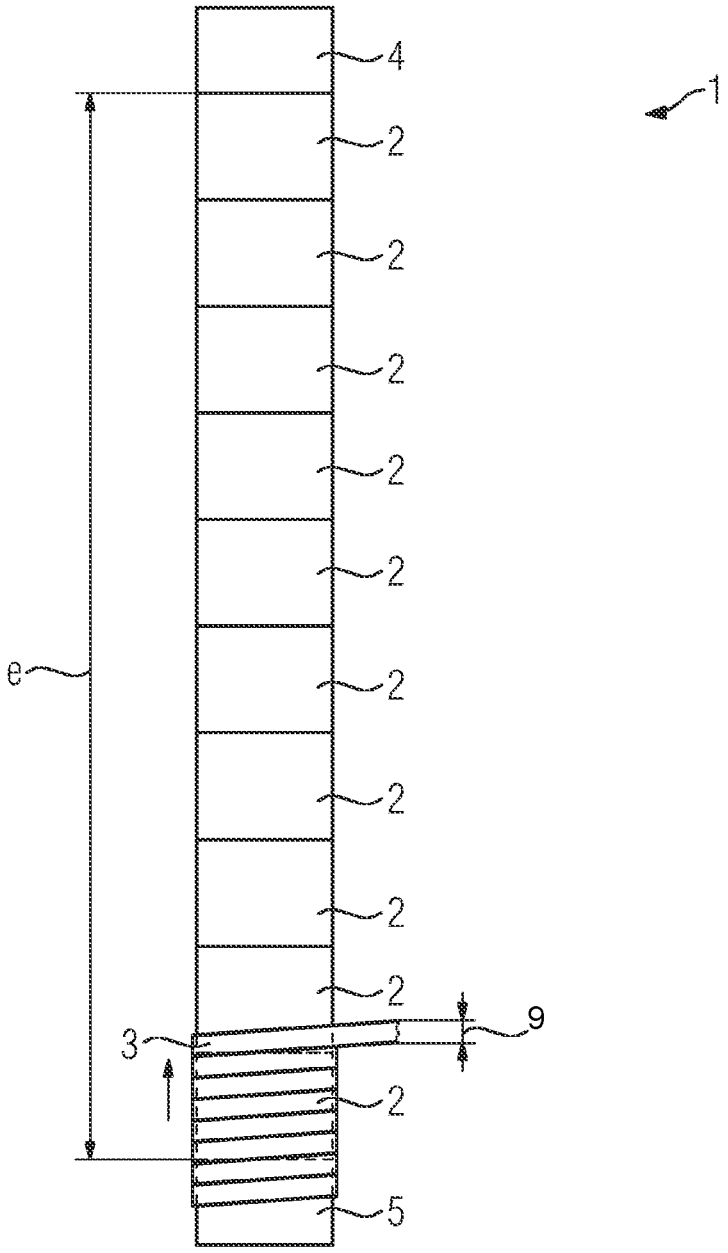
FIG. 1 shows an intermediate step in the production of a surge arrester.

FIG. 1 shows an intermediate step in the production of an item of electrical equipment. A surge arrester 1 for medium-voltage applications, which comprises a core having a plurality of varistor disks 2 in an arrester column, is shown. End fittings 4, 5 are respectively arranged at the ends of the arrester column. A tape 9 which comprises a glass fiber material 3 is wrapped around the arrester column, the glass fiber material 3 being preimpregnated with a resin. The tape 9 has a width d which is less than the length e of the core having the varistor disks 2, so that it can be wrapped circumferentially and slightly obliquely around the core.

Figure 2:
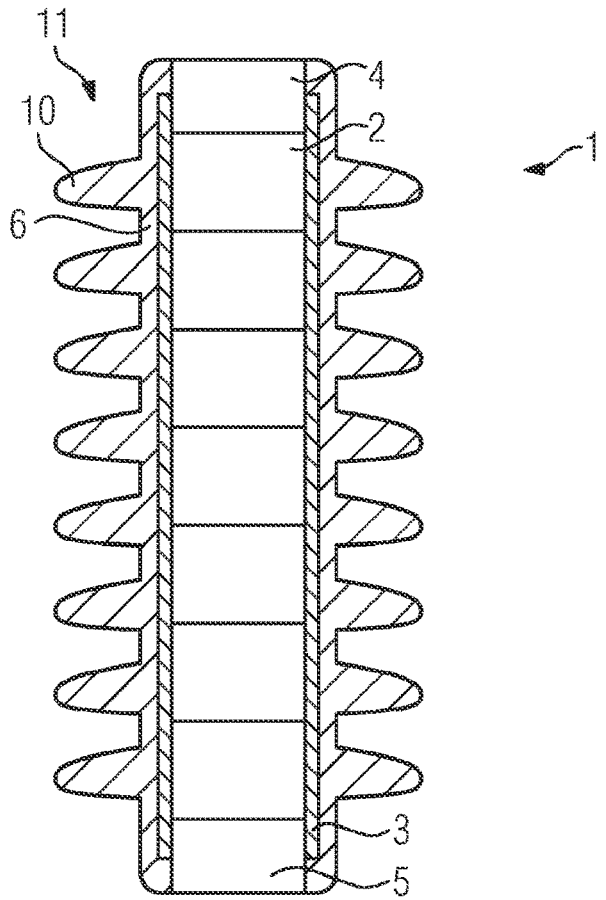
FIG. 2 shows an exemplary embodiment of a surge arrester.

FIG. 2 shows a cross section through an exemplary embodiment of a completed surge arrester, although only the technical details required for the invention are shown. The varistor disks 2, or the arrester column, are fully provided with a layer 6 which is applied onto the glass fiber material 3. The layer 6 consists of a substance which consists at least partially of high-temperature vulcanizing (HTV) silicone rubber.

A housing 11 having creepage path-lengthening shields 10 is provided on the layer 6, the housing 11 likewise consisting of the material, i.e. also at least partially comprising a high-temperature vulcanizing silicone rubber. In this case, the layer 6 and the housing 11 with shields 10 were produced in a single injection molding step.

Figure 3:
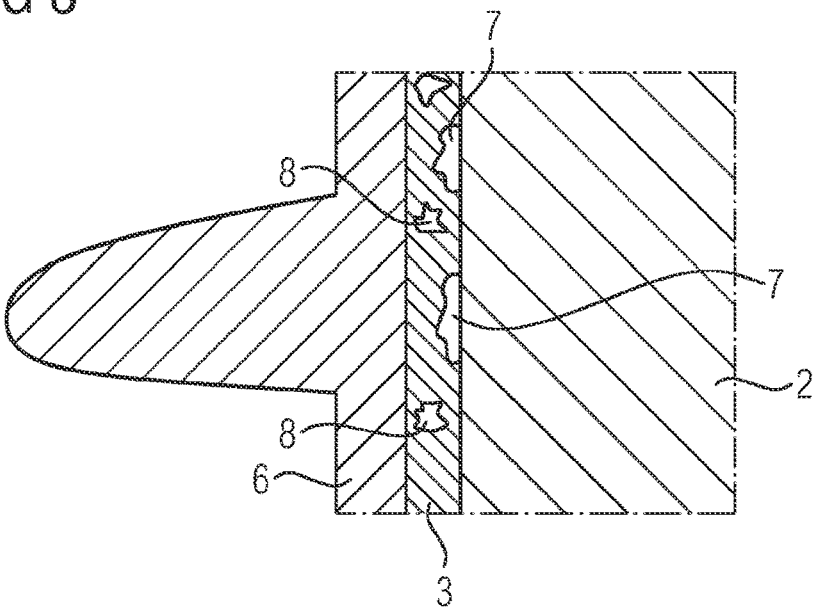
FIG. 3 shows a detail view of the exemplary embodiment according to FIG. 1.

It is shown in FIG. 3 that the substance comprising the HTC silicone is applied by the injection molding method under high pressure in such a way that cavities 7 between the core having the varistor disks 2 and the glass fiber material 3 are substantially filled with the substance. Cavities 8 in the glass fiber material are also substantially filled with the substance.

The exemplary embodiment of the invention has the advantage that an item of equipment, for example a surge arrester, can be produced economically and so as to be particularly weather-resistant. Furthermore, partial discharges through cavities are reduced or substantially avoided.

The invention claimed is:

1. A surge arrester, comprising:

a core being an arrester column;

a glass fiber material cladding said core, said glass fiber material being preimpregnated with a resin; and a layer of a substance formed at least partially of high-temperature vulcanizing silicone rubber, said layer being applied onto said glass fiber material;

said layer at least partially filling cavities between said core and said glass fiber material with said substance.

2. The surge arrester according to claim 1, wherein said layer at least partially fills cavities in said glass fiber material with said substance.

3. The surge arrester according to claim 1, wherein said glass fiber material is wrapped around said core.

4. The surge arrester according to claim 3, wherein said glass fiber material is applied as a tape having a width being less than a length of said core.

5. The surge arrester according to claim 4, wherein said tape is wrapped around said core multiple times.

6. The surge arrester according to claim 1, which further comprises a housing having creepage path-lengthening shields, said housing being provided on said layer, and said housing being formed of a material at least partially including a high-temperature vulcanizing silicone rubber.

7. The surge arrester according to claim 1, wherein set a restore column has a plurality of varistor disks.

8. The surge arrester according to claim 7, wherein the surge arrester is configured for medium-voltage applications.

9. A production method for surge arrester, the production method comprising:

stabilizing a core by cladding the core with a glass fiber material, the glass fiber material being preimpregnated with a resin; and applying a layer of a substance onto the glass fiber material by using an injection molding method, and at least partially using a high-temperature vulcanizing silicone rubber for the substance.

10. The production method according to claim 9, which further comprises at least partially filling cavities between the core and the glass fiber material with the substance by carrying out the step of applying the layer.

11. The production method according to claim 9, which further comprises at least partially filling cavities in the glass fiber material with the substance by carrying out the step of applying the layer.

12. The production method according to claim 9, wherein the core is an arrester column of the surge arrester having a plurality of varistor disks.

13. The production method according to claim 9, which further comprises applying a housing having creepage path-lengthening shields on the layer, and using a substance at least partially including a high-temperature vulcanizing silicone rubber for the housing.

14. A device, comprising:

a core;

a glass fiber material cladding said core, said glass fiber material being preimpregnated with a resin; and a layer of a substance formed at least partially of high-temperature vulcanizing silicone rubber, said layer being applied onto said glass fiber material;

said layer at least partially filling cavities between said core and said glass fiber material with said substance.

* * * * *